United States Patent [19]

Poehlmann

[11] 3,942,249

[45] Mar. 9, 1976

[54] KNIFE

[76] Inventor: Paul W. Poehlmann, P. O. Box 445, Stinson Beach, Calif. 94970

[22] Filed: Apr. 2, 1975

[21] Appl. No.: 564,315

[52] U.S. Cl. ..... 30/160; 30/161

[51] Int. Cl.[2] ... B26B 1/02; B26B 1/04; B26B 29/02

[58] Field of Search ..... 30/155, 158, 159, 160, 30/161

[56] References Cited

UNITED STATES PATENTS

| | | | |
|---|---|---|---|
| 400,987 | 4/1889 | Wilzin | 30/159 |
| 492,084 | 2/1893 | Brigham | 30/159 |
| 603,847 | 5/1898 | Harvey | 30/161 |
| 1,701,027 | 2/1929 | Brown | 30/159 |
| 2,286,524 | 6/1942 | Wilbur | 30/161 |
| 2,530,236 | 11/1950 | Erickson | 30/159 |

FOREIGN PATENTS OR APPLICATIONS

| | | | |
|---|---|---|---|
| 549,428 | 11/1942 | United Kingdom | 30/160 |

*Primary Examiner*—Al Lawrence Smith
*Assistant Examiner*—J. T. Zatarga
*Attorney, Agent, or Firm*—Lothrop & West

[57] ABSTRACT

A knife for personal use has a liner made up of a pair of parallel walls spaced apart along a transverse axis at right angles to the longitudinal extent of the walls. A hollow hub extends along the axis and abuts bearing surfaces in the walls and also abuts a bearing surface in a blade disposed between the walls. The hub has at least a first notch extending radially of the axis. A second notch in one of the walls extending radially of the axis is adapted to register with the first notch. A third notch in the blade is adapted to register radially of the axis with the first and second notches. A thimble-like detent is mounted for axial movement relative to and partially within the hub. A key projects radially from the detent and has an axial extent effective in one axial position of the detent to lie wholly within the third notch and in another axial position of the detent to occupy a position lying within the second and third notches simultaneously. A spring preferably housed within the detent and the hub urges the detent into a projected position.

14 Claims, 10 Drawing Figures

KNIFE

Knives, particularly those to be carried on the person for general usage, fall into various categories, such as pen knives, pocket knives, hunting knives, and the like. In some instances the blade is arranged to fold into the liner or handle when not in use in order that the sharp blade may be housed and protected. In the folding type of knife, there is a need for the sheathing of the blade to be quickly and safely taken care of, for the blade to be quickly made available, and also for the blade to be quite secure and firm when unfolded for use. It is also important that the mechanism controlling the knife blade between its housed and exposed positions be accurate in its operation so that there is no inadvertent operation of the structure.

It is therefore an object of the invention to provide a knife which meets the foregoing requirements.

Another object of the invention is to provide a knife particularly effective in its mechanism for secure and protracted operation.

Another object of the invention is in general to provide an improved knife.

Other objects, together with the foregoing, are attained in the embodiment of the invention described in the accompanying description and illustrated in the accompanying drawings, in which.

Figure 2:
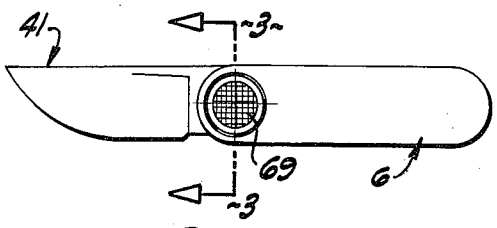
FIG. 2 is a side elevation of the knife with the blade in extended position.

While the knife of the invention can be embodied in a large number of different ways, depending upon its intended use and upon the preferences of the user, it has with success been embodied in the form shown herein. In this arrangement, there is provided a base or frame or liner, generally designated 6, made up of a pair of elongated, parallel walls 7 and 8 having any appropriate contour. The liner walls are held spaced apart by an intervening plate 9 secured to the walls by fasteners 11 and 12; for example, rivets. This mechanism provides an assembly generally defining a long and narrow interior channel 13 in an appropriate handle symmetrical about a longitudinal axis.

One of the walls 7 adjacent one end is provided with a through aperture 16 affording a circular-cylindrical bearing surface 17 symmetrical about a transverse axis 18. Adjacent the bearing surface 17, the wall 7 is formed to afford a recess 19 having a depth approximately half the thickness of the wall.

Designed to extend into the recess 19 and to abut the bearing surface 17 is a hub 21. This is a largely hollow member having a solid end 22 terminating in a circular flange 23 or rim adapted to occupy most of the recess 19. A circular-cylindrical surface 24 of the hub is shaped to abut the bearing surface 17 and is symmetrical about the transverse axis 18.

The hub is interrupted through the circular-cylindrical surface 24 by a first notch 26. In most designs, an opposite, duplicate first notch 27 is also provided. the notches are arranged on a diameter across the hub and have an axial extent equal to a substantial portion of the hub length.

The hub is assembled with the wall 7 by passing the hub body through the aperture 16 to extend across the gap or channel 13 to project into and through a bearing surface 28 of circular-cylindrical nature symmetrical about the transverse axis 18. The surface 28 is the boundary of an aperture 29 in the wall 8. Formed in the wall 8 and adjoining the aperture 29 is a recess 31 defined by a circular-cylindrical wall 32 and by a radial wall 33.

The length of the hub is such that it extends through the aperture 29, bearing against the surface 28, and projects into the recess 31. When installed, the hub is removably retained in position by a threaded ring 36 in the recess 31 in abutment with the radial wall 33. The ring engages threads 37 all around the circular-cylindrical hub 24, except for interruptions by the first notch 26 and the additional, first notch 27.

Particularly pursuant to the invention, the hub is positioned in the two walls 7 and 8 with the first notches 26 and 27 in a special orientation. For that reason, the wall 8 is provided with a second notch 38 and an additional second notch 39. These notches 38 and 39 and notches 26 and 27 are held congruent in the sheathed and active conditions of the knife.

Figure 1:
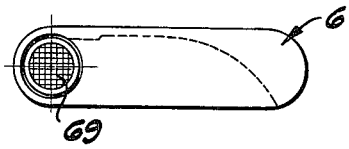
FIG. 1 is a side elevation of the knife in closed position.
Figure 3:
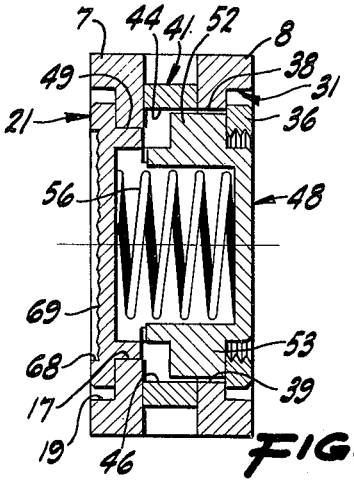
FIG. 3 is a cross-section to an enlarged scale, the plane of section being indicated by the line 3—3 of FIG. 2.
Figure 4:
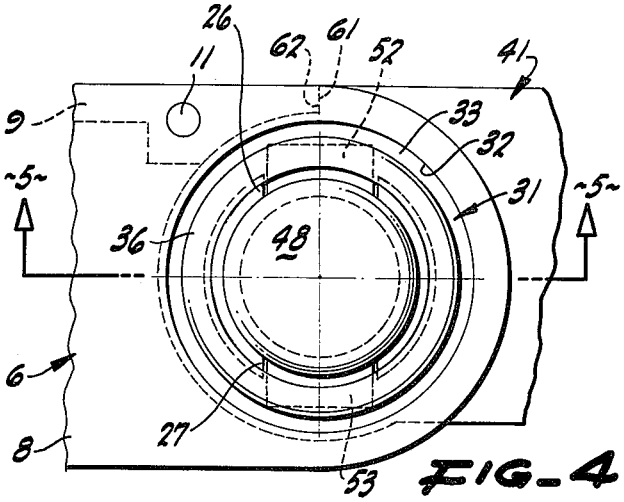
FIG. 4 is a side elevation of a part of the knife shown at the right side of FIG. 3.
Figure 6:
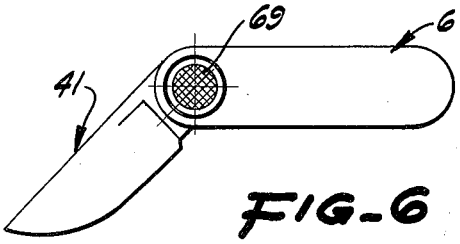
FIG. 6 is a side elevation comparable to FIGS. 1 and 2 but showing the blade in an intermediate position.
Figure 5:
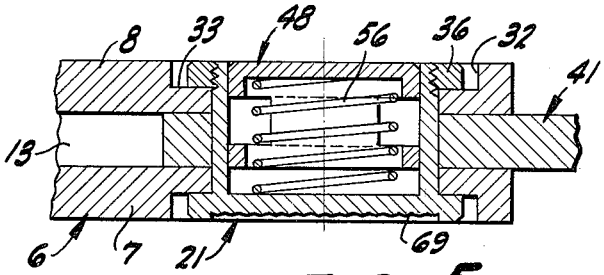
FIG. 5 is a cross-section, the plane of which is indicated by the line 5—5 of FIG. 4.
Figure 7:
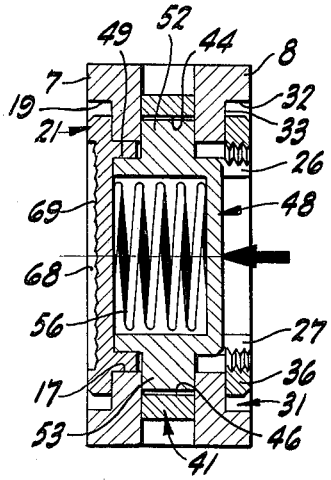
FIG. 7 is a cross-section like FIG. 3 but showing the parts in blade-released position.
Figure 8:
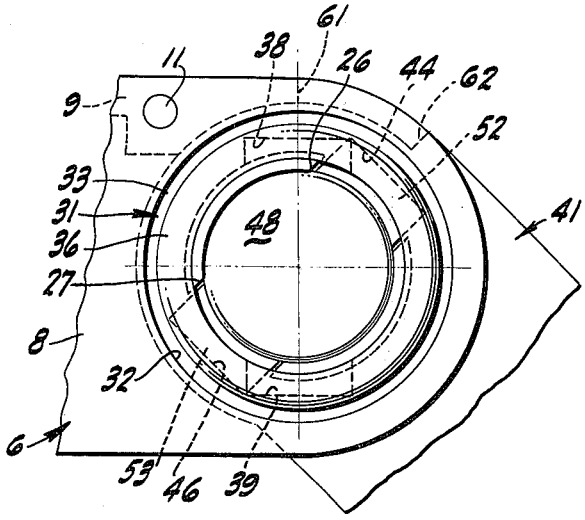
FIG. 8 is a view like FIG. 4 but showing the parts with the blade in an intermediate position.

A knife blade 41 of any selected configuration is provided to swing about the axis 18 between an extended or open position as shown in FIG. 2 and a sheathed or closed position, as shown in FIG. 1. An intermediate position is shown in FIG. 6.

The knife blade 41 has a base 42 of an axial width easily to fit in the channel 13 in approximate abutment with the walls 7 and 8. The knife has a circular-cylindrical, bearing wall 43 defining an aperture therethrough. Interrupting the aperture is a third notch 44 and an additional third notch 46. These notches are substantially congruent with the notches 26 and 27 under certain conditions.

Particular means are provided for maintaining the position of the knife blade 41 with respect to the knife liner 6 in at least two extreme positions. For that reason, there is provided a detent 48. This is a thimblelike or hollow drum body having a circular-cylindrical exterior bearing surface 49 divided into two principal, separated portions, each of which is receivable in any of the bearings 17, 28 and 43. Additionally, the hollow detent 48 includes a pair of integral keys 52 and 53 extending radially from the body of the detent 48. The keys can occupy positions on an axis transverse to the longitudinal axis of the knife. Each key has an axial dimension of an extent to lie entirely within the width of the base 42 of the knife blade and is sized to make a snug fit therewith and smoothly to be axially displaced therefrom.

When the parts are assembled, the thimble-like detent 48 is introduced into the interior bore of the hub 21 and the keys 52 and 53 entirely or partly occupying the notches 44 and 46 or partially occupying the notches 38 and 39. This assembly is made over a helical spring 56 at least partly contained within the detent and bearing at one end on the head of the hub 21 and at the other end on the head of the detent. The spring normally urges the detent against the retaining ring 36. Normally the keys 52 and 53 lodge in both the slots in the blade head and the slots in the liner wall 8.

With this relationship of the parts, the blade 41 is held immovably with respect to the liner because the keys 52 and 53 prevent any relative rotation therebetween. However, by pressure, the detent 48 can be displaced inwardly along the axis 18 against the urgency of the spring 56. The keys 52 and 53 are then moved axially out of engagement with the notches 38 and 39 in the wall 8 and are entirely contained within the width of the blade base 42, occupying the notches 44 and 46 only. In this compacted or telescoped relationship of the parts, an additional, rotary force imposed on the hub and on the depressed detent 48 by the thumb and finger of the user, for example, holds the spring 56 compressed and rotates the blade about the axis 18. The blade travel is from one extreme position toward and into another extreme position about 180° away from the first position.

In the second relative location of the parts, the spring when released is effective to move the keys 52 and 53 part way out of the notches 44 and 46 and again to engage the wall 8 in the notches 38 and 39, with the keys 52 and 53 inverted from their first relationship. In this position of the parts, the knife blade is keyed into or locked into the liner and is firmly held there.

The only way that the blade can be released from its sheathed position or from its extended position is by the exertion of a transverse axial force on the detent with respect to the remaining parts of the knife. When that has been done, imposition of rotary force on the detent and the hub rotates the knife blade with those parts until it is in either extreme position. In either such position, release of the axial force causes the spring 56 to snap the keys into their blade and liner engagement with both the notches 44 and 46 and the notches 38 and 39.

Figures 9, 10:
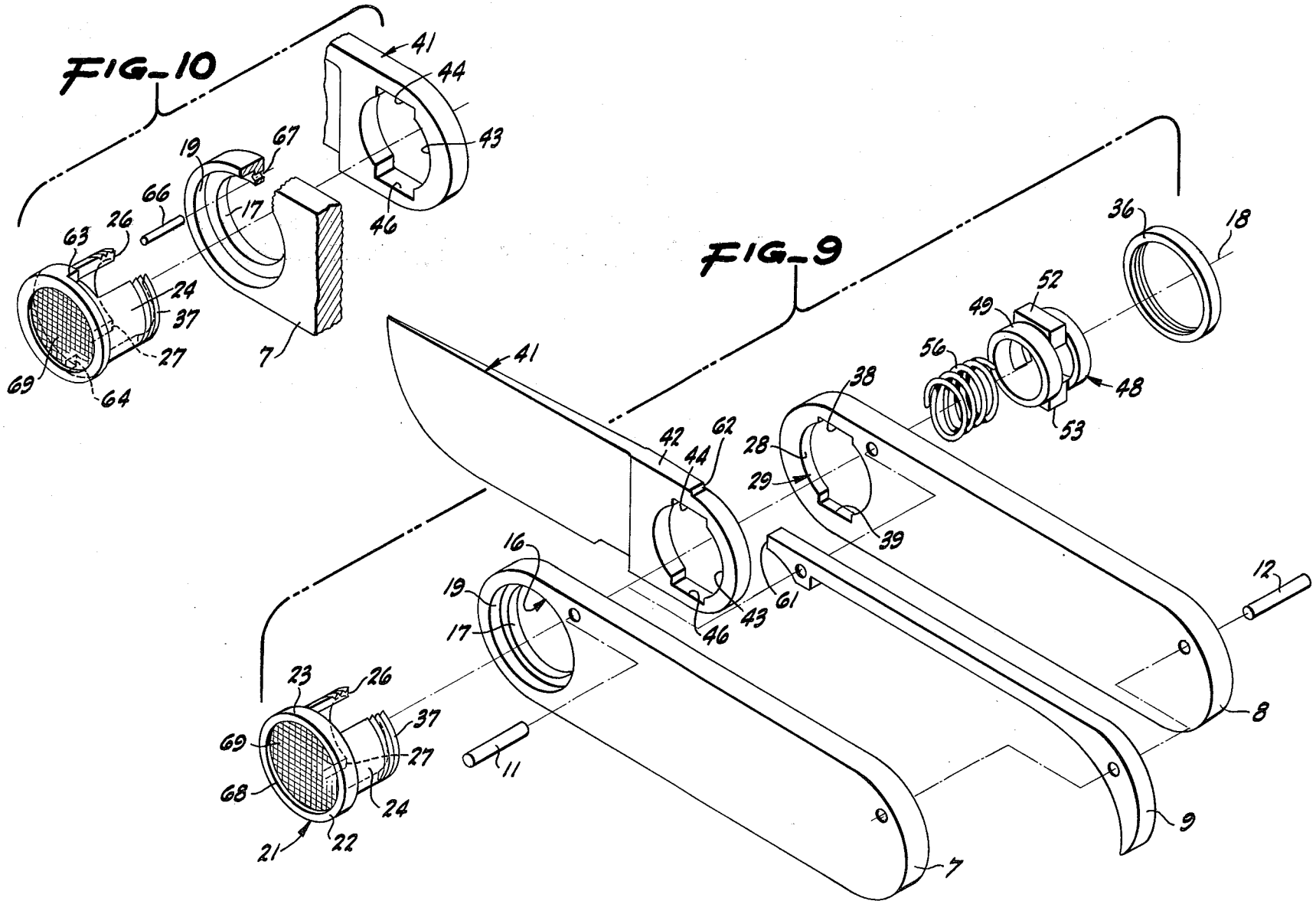
FIG. 9 is a view in isometric perspective showing the knife parts in exploded positions.
FIG. 10 is a view like FIG. 9 in part, showing modifications of some structures.

In one manner of construction, as shown particularly in FIG. 9, the preference, for a smooth exterior appearance and finish when open, is to terminate the plate 9 at one end in a surface 61 that extends axially and radially with regard to the knife base 42. The base has an arcuate termination ending in a step surface 62. In the projected position of the knife blade, the surface 62 abuts the surface 61 or very nearly so. There is no particular force between those parts, the stop function being accomplished by the internal keys. This manner of finish avoids a feather edge termination on the plate 9 where it lies against the arcuate portion of the knife base.

As shown particularly in FIG. 10, an alternative form of stop can be provided if desired. In this instance, the hub 21' has its flange 23' interrupted on opposite sides with respect to the axis 18 to afford stop surfaces 63 and 64. In this instance, the wall 7' is provided at one point with an axially extending pin 66 lodged in a bore 67. In one extreme position of the hub with respect to the wall 7' the pin 66 lies against the stop surface 63, and in a position 180° thereto the pin 66 lies against the stop surface 64.

As a particular refinement because of the frequent use of the hub head as a rotating device, the head 23 has an indentation 68 or concavity, when seen from the outside, interrupted by cross bars or roughening 69. The head 48 of the detent can be similarly roughened or made irregular. The user can then firmly grasp and telescope the hub and detent between his thumb and forefinger and can easily rotate the blade with respect to the knife liner.

Although not shown, the liner walls 7 and 8 can be externally provided in the customary fashion with any selected sort of decoration or trim.

A knife constructed as disclosed herein is readily operated between its two extreme positions and affords a safe, simple, accurate, longlived, and economical mechanism for a folding knife.

What is claimed is:

1. A knife comprising a liner including a pair of parallel walls spaced apart along a transverse axis, means defining a pair of bearing surfaces in said walls and in alignment on said axis, a hub extending along said axis and abutting both of said bearing surfaces, a blade disposed between said walls, means defining a bearing surface in said blade and abutting said hub, means defining a first notch in said hub extending radially of said axis and extending axially the length of the hub between said bearing surfaces including at least partly through one of said walls, means defining a second notch in said one of said walls radially longer than said first notch and adapted to register radially of said axis with said first notch, means defining a third notch in said blade radially at least as long as said second notch and adapted to register radially of said axis with said first notch and said second notch, a detent, means for mounting said detent for axial movement relative to said hub, a key projecting radially from said detent, riding in and projecting beyond said first notch and having a radial length to extend into each of said second and third notches, the portion of said key projecting beyond said first notch having an axial extent effective in a first axial position of said detent to lie wholly within said third notch, and means for resiliently urging said detent out of said first position and toward a second axial position with said portion of said key lying partly in said third notch and partly in said second notch.

2. A knife as in claim 1 in which one of said bearing surfaces is uninterrupted and the other of said bearing surfaces is interrupted by said second notch.

3. A knife as in claim 1 including a first recess in one of said walls adjacent said bearing surface therein.

4. A knife as in claim 1 including a second recess in the other one of said walls adjacent said bearing surface therein.

5. A knife as in claim 1 including means defining duplicates of said first, second, and third notches respectively in said hub, said one of said walls and said blade, and including a second key on said detent substantially duplicating said first mentioned key on said detent.

6. A knife as in claim 5 in which said duplicate notches and said second key are respectively opposite said first, second, and third notches and said first mentioned key.

7. A knife as in claim 1 including means for releasably holding said hub in axial position relative to said liner.

8. A knife as in claim 1 including means on said hub for augmenting a thumb and finger grip thereof.

9. A knife as in claim 1 in which said hub is hollow and said detent telescopes axially therein.

10. A knife as in claim 1 in which said detent is thimble-shaped and with said hub defines a central chamber.

11. A knife as in claim 10 in which said resilient urging means is a helical spring disposed in said central chamber in abutment with said hub and said detent.

12. A knife as in claim 3 including a flange on said hub disposed in said first bearing recess.

13. A knife as in claim 3 including a ring movably engaged with said hub and disposed in said second bearing recess.

14. A knife as in claim 6 in which said liner has a longitudinal axis, and said second notches extend transversely of said longitudinal axis.

* * * * *